US008967043B2

(12) United States Patent
Rondon et al.

(10) Patent No.: US 8,967,043 B2
(45) Date of Patent: Mar. 3, 2015

(54) ABLATION-TYPE LITHOGRAPHIC PRINTING MEMBERS HAVING IMPROVED EXPOSURE SENSITIVITY AND RELATED METHODS

(75) Inventors: Sonia Rondon, Nashua, NH (US); Kevin Ray, Windham, NH (US)

(73) Assignee: Presstek, Inc., Hudson, NH (US)

( * ) Notice: Subject to any disclaimer, the term of this patent is extended or adjusted under 35 U.S.C. 154(b) by 896 days.

(21) Appl. No.: 13/109,651

(22) Filed: May 17, 2011

(65) Prior Publication Data

US 2012/0291643 A1 Nov. 22, 2012

(51) Int. Cl.

| | |
|---|---|
| ***B41M 1/08*** | (2006.01) |
| ***B41C 1/10*** | (2006.01) |
| *B41N 1/00* | (2006.01) |

(52) U.S. Cl.

CPC ..... *B41C 1/1033* (2013.01); *B41C 2201/02* (2013.01); *B41C 2210/262* (2013.01); *B41N 1/003* (2013.01)

USPC ..... 101/395; 101/450.1; 101/463.1

(58) Field of Classification Search

CPC ..... B41C 1/1033

See application file for complete search history.

(56) References Cited

U.S. PATENT DOCUMENTS

| | | | |
|---|---|---|---|
| 5,339,737 | A | 8/1994 | Lewis et al. |
| 6,194,122 | B1 | 2/2001 | Ichikawa et al. |
| 6,344,306 | B1 | 2/2002 | Fujiyoshi et al. |
| 6,576,399 | B1 | 6/2003 | Gries et al. |
| 2001/0026902 | A1 | 10/2001 | Hirano et al. |
| 2004/0005514 | A1 | 1/2004 | Saraiya et al. |
| 2004/0224256 | A1 | 11/2004 | Figov |
| 2009/0253069 | A1 | 10/2009 | Melamed et al. |
| 2009/0305162 | A1 | 12/2009 | Melamed et al. |
| 2012/0055363 | A1 | 3/2012 | Danzinger et al. |
| 2012/0291644 | A1 | 11/2012 | Rondon et al. |
| 2012/0291645 | A1 | 11/2012 | Rondon et al. |
| 2012/0312183 | A1 | 12/2012 | Rondon et al. |

FOREIGN PATENT DOCUMENTS

| | | | |
|---|---|---|---|
| EP | 1788431 | A2 | 5/2007 |
| EP | 2425985 | A2 | 3/2012 |
| WO | 2014/031828 | A1 | 2/2014 |

OTHER PUBLICATIONS

Allnex Product Guide. www.allnex.com. Retrieved Jun. 2, 2014.*

International Search Report and Written Opionion mailed Aug. 6, 2012 for International Application No. PCT/US2011/73065560 (10 pages).

Written Opionion mailed Nov. 19, 2013 for International Application No. PCT/US2012/034879 (6 pages).

Holmberg, Krister, "Low Temperature Acid Catalyzed Curing of Melamine Resin Systems", Polymer Bulletin, vol. 11, 1984, pp. 81-84.

Porwal, Harshad, "Cytec Cymel Resins", Cytec CYMEL Product Guide, 2010, pp. 1-8.

* cited by examiner

*Primary Examiner* — Joshua D Zimmerman

(74) *Attorney, Agent, or Firm* — Morgan, Lewis & Bockius LLP

(57) ABSTRACT

Ablation-type printing plates having improved exposure sensitivity are produced using an imaging layer—i.e., the plate layer that absorbs and ablates in response to imaging radiation—whose composition includes a large proportion of crosslinker.

28 Claims, 1 Drawing Sheet

ABLATION-TYPE LITHOGRAPHIC PRINTING MEMBERS HAVING IMPROVED EXPOSURE SENSITIVITY AND RELATED METHODS

BACKGROUND OF THE INVENTION

In offset lithography, a printable image is present on a printing member as a pattern of ink-accepting (oleophilic) and ink-rejecting (oleophobic) surface areas. Once applied to these areas, ink can be efficiently transferred to a recording medium in the imagewise pattern with substantial fidelity. Dry printing systems utilize printing members whose ink-repellent portions are sufficiently phobic to ink as to permit its direct application. In a wet lithographic system, the non-image areas are hydrophilic, and the necessary ink-repellency is provided by an initial application of a dampening fluid to the plate prior to inking. The dampening fluid prevents ink from adhering to the non-image areas, but does not affect the oleophilic character of the image areas. Ink applied uniformly to the printing member is transferred to the recording medium only in the imagewise pattern. Typically, the printing member first makes contact with a compliant intermediate surface called a blanket cylinder which, in turn, applies the image to the paper or other recording medium. In typical sheet-fed press systems, the recording medium is pinned to an impression cylinder, which brings it into contact with the blanket cylinder.

To circumvent the cumbersome photographic development, plate-mounting, and plate-registration operations that typify traditional printing technologies, practitioners have developed electronic alternatives that store the imagewise pattern in digital form and impress the pattern directly onto the plate. Plate-imaging devices amenable to computer control include various forms of lasers.

Current laser-based lithographic systems frequently rely on removal of an energy-absorbing layer from the lithographic plate to create an image. Exposure to laser radiation (typically in the near-infrared (IR) range) may, for example, cause ablation—i.e., catastrophic overheating—of the ablated layer in order to facilitate its removal. Because ablation produces airborne debris, ablation-type plates must be designed with imaging byproducts in mind; for example, the plate may be designed so as to trap ablation debris between layers, at least one of which is not removed until after imaging is complete.

Dry plates, which utilize an oleophobic topmost layer of fluoropolymer or, more commonly, silicone (polydiorganosiloxane), exhibit excellent debris-trapping properties because the topmost layer is tough and rubbery; ablation debris generated thereunder remains confined as the silicone or fluoropolymer does not itself ablate. Where imaged, the underlying layer is destroyed or de-anchored from the topmost layer. A common three-layer plate, for example, is made ready for press use by image-wise exposure to imaging (e.g., infrared or "IR") radiation that causes ablation of all or part of the central layer, leaving the topmost layer de-anchored in the exposed areas. Subsequently, the de-anchored overlying layer and the central layer are removed (at least partially) by a post-imaging cleaning process—e.g., rubbing of the plate with or without a cleaning liquid—to reveal the third layer (typically an oleophilic polymer, such as polyester).

The commercial viability of any printing system depends critically on the speed at which a printing plate can be imaged, and secondarily on the required laser power. These two parameters are intimately related, as higher laser power results in greater beam fluence, delivering a greater quantity of energy with each imaging pulse. Within limits, higher beam fluence levels increase the rate at which ablation takes place, so that imaging can be carried out at faster speeds—that is, each imaging pulse can be of shorter duration, so the plate can be imaged more quickly.

The relationship between laser power and imaging speed is not strictly inverse, however, and increasing laser power soon leads to diminishing returns, as the responsiveness of the plate imaging layer is constrained by physico-chemical characteristics that limit the rate at which ablation can take place. Moreover, high-power lasers are expensive both to procure and to operate, and can cause damage to the plate beyond the intended results of ablation. Accordingly, increases in imaging speed are desirably realized through improvements in plate characteristics. Such improvements are not easily achieved, however, because increasing exposure sensitivity typically degrades the durability of the plate. For example, sensitivity can be improved by thinning the plate layers or increasing the loading level of an IR-absorbing material, but the result is a more delicate plate structure.

SUMMARY OF THE INVENTION

It has been found, surprisingly, that plates having improved exposure sensitivity can be produced using an imaging layer—i.e., the plate layer that absorbs and ablates in response to imaging radiation—whose composition includes a large proportion of crosslinker. In a typical matrix for a polymeric imaging layer, the "binder" resin predominates (typically at levels in the 70% range) and the crosslinker is present at a much lower level (e.g., in the 10% range). Imaging-layer compositions in accordance with the present invention achieve improved speed with good durability at much higher levels of crosslinker, e.g., on the order of 80% or more of the composition in some embodiments. For example, whereas a prior-art composition based on a resole resin might contain 12 to 25% IR-absorptive dye, 15% melamine crosslinker, 0.7 to 4.8% sulfonic acid catalyst, and 70% resole resin, a corresponding formulation in accordance herewith may contain 12 to 25% IR-absorptive dye, 80% melamine crosslinker, 0.7 to 4.8% sulfonic acid catalyst, less than 25% (and as little as zero) resole resin. The term "resole resin" refers to the the reaction of phenol with an aldehyde (usually formaldehyde) under alkali conditions with an excess of formaldehyde. The molar ratio of phenol to aldehyde is typically 1:1.1 to 1:3, and the excess formaldehyde causes the resulting polymer to have many $CH_2OH$ (methylol) pendant groups. This distinguishes resoles from other phenolic resins (including phenol formaldehyde resins such as novolaks, which are prepared under acidic conditions with an excess of phenol rather than aldehyde).

Without being bound to any particular theory or mechanism, it is hypothesized that, after exposure, the ablation debris generated in a plate in accordance with the present invention is water compatible or otherwise easier to remove during cleaning, resulting in the ability to tolerate less complete ablation and, consequently, faster imaging at a given fluence level. It is also found that the curing temperature of the imaging layer during plate manufacture can be important to plate performance, since too much heat during curing compromises the sensitivity of the finished plate while inadequate heat leads to incomplete cure and consequent plate instability. Curing temperatures ranging from 220 to 320° F., and especially 240 to 280° F., have been used to advantage.

Accordingly, in a first aspect, the invention relates to a printing member comprising an oleophilic first layer; an imaging layer disposed over the first layer and having (i) a cured resin phase consisting essentially of a melamine resin and a resole resin, where the resole resin is present in an amount ranging from 0% to 28% by weight of dry film, and (ii) a near-IR absorber dispersed within the cured resin phase; and an oleophobic third layer disposed over the imaging layer. In some embodiments the cured resin phase contains no resole resin, while in other embodiments the resole resin constitutes up to 15% or even as much as 28% of the imaging layer by weight. The near-IR absorber may consist essentially of a dye, and may constitute up to 25% of the imaging layer by weight of dry film. IR-absorptive dyes include cyanines and phthalocyanines. In some embodiments, however, near-IR-absorbing dyes and pigments are used.

The melamine resin may constitute up to 88% of the imaging layer by weight. The melamine resin may be a methylated, low-methylol, high-imino melamine. In some embodiments, the melamine resin has a viscosity ranging from 7000 to 15,000 centipoises at 23° C., while in other embodiments, the melamine resin has a viscosity ranging from and 1000 to 1600 centipoises at 23° C. As will be described below, the viscosity of the melamine is related to the proper level of a p-toluenesulfonic acid catalyst. In various embodiments, the imaging layer has a dry coating weight of at least 0.5 $g/m^2$.

The third layer may consist essentially of silicone. The first layer may be polymeric or a metal. Some embodiments include a fourth layer disposed between the first and second layers; the fourth layer comprises a cured polymer containing a dispersion of near-IR-absorbing pigment, which assists with imaging. The pigment may, for example, be carbon black, which is typically present at a loading level no greater than 20 or 25%.

In another aspect, the invention relates to a method of imaging a printing member. In various embodiments, the method comprises providing a printing member that comprises (i) an oleophilic first layer; (ii) disposed over the first layer, an imaging layer having (A) a cured resin phase consisting essentially of a melamine resin and a resole resin, the resole resin being present in an amount ranging from 0% to 28% by weight of dry film, and (B) a near-IR absorber dispersed within the cured resin phase; and (iii) an oleophobic third layer disposed over the imaging layer. The printing member is exposed to imaging radiation in an imagewise pattern, and the imaging radiation at least partially ablates the imaging layer where exposed. The imaged printing member is subjected to an aqueous liquid to remove the imaging and third layers where the printing member received imaging radiation, thereby creating an imagewise pattern on the printing member. The printing member may then be used on a printing press to transfer ink to a recording medium.

In various embodiments, the imaging radiation has a fluence not exceeding 200 $mJ/cm^2$, and in some implementations, not exceeding 150 $mJ/cm^2$. The aqueous liquid may be plain tap water, or may comprise water and an organic solvent (e.g., an alcohol such as a glycol). The printing member may further comprises a fourth layer disposed between the first and second layers; the fourth layer comprises a cured polymer containing an dispersion of near-IR-absorbing pigment.

In yet another aspect, the invention pertains to a method of making an ablation-type printing member. The method comprises providing a precursor structure having an oleophilic surface; coating, over the precursor structure, a resin composition having (A) a resin phase consisting essentially of a melamine resin and a resole resin, the resole resin being present in an amount ranging from 0% to 28% by weight of dry film, and dispersed within the resin phase, a near-IR absorber; curing the resin composition; coating an oleophobic polymer composition over the cured resin composition; and curing the oleophobic polymer composition. The resin composition may be cured at a temperature ranging from 220 to 320° F., e.g., from 240 to 280° F.

As used herein, the term "plate" or "member" refers to any type of printing member or surface capable of recording an image defined by regions exhibiting differential affinities for ink and/or fountain solution. Suitable configurations include the traditional planar or curved lithographic plates that are mounted on the plate cylinder of a printing press, but can also include seamless cylinders (e.g., the roll surface of a plate cylinder), an endless belt, or other arrangement.

"Ablation" of a layer means either rapid phase transformation (e.g., vaporization) or catastrophic thermal overload, resulting in uniform layer decomposition. Typically, decomposition products are primarily gaseous. Optimal ablation involves substantially complete thermal decomposition (or pyrolysis) with limited melting or formation of solid decomposition products.

The term "substantially" means ±10% (e.g., by weight or by volume), and in some embodiments, ±5%. The term "consists essentially of" means excluding other materials that contribute to function or structure. For example, a resin phase consisting essentially of a melamine resin and a resole resin may include other ingredients, such as a catalyst, that may perform important functions but do not constitute part of the polymer structure of the resin. Percentages refer to weight percentages unless otherwise indicated.

DESCRIPTION OF DRAWINGS

In the following description, various embodiments of the present invention are described with reference to FIGS. 1A and 1B, which show enlarged cross-sectional views of printing members according to the invention.

DETAILED DESCRIPTION

1. Printing Plates

Figure 1A:
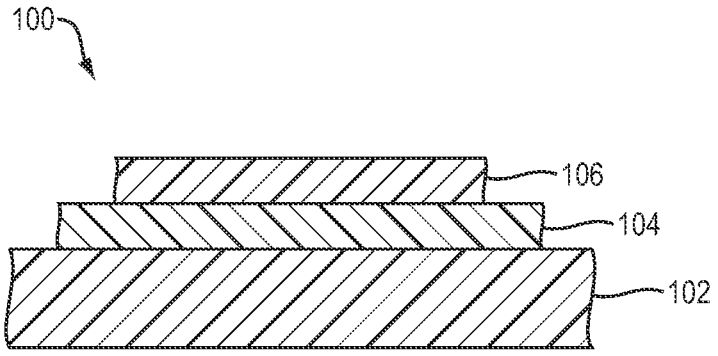

FIG. 1A illustrates a negative-working printing member 100 according to the present invention that includes a substrate 102, an imaging layer 104, and a topmost layer 106. Layer 104 is sensitive to imaging (generally IR) radiation as discussed below, and imaging of the printing member 100 (by exposure to IR radiation) results in imagewise ablation of the layer 104. The resulting de-anchorage of topmost layer 106 facilitates its removal by rubbing or simply as a result of contact during the print "make ready" process. Preferably, the ablation debris of layer 104 is chemically compatible with water in the sense of being acted upon, and removed by, an aqueous liquid following imaging. Substrate 102 (or a layer thereover) exhibits a lithographic affinity opposite that of topmost layer 106. Consequently, ablation of layer 104, followed by imagewise removal of the layer 106 to reveal an underlying layer or the substrate 102, results in a lithographic image.

Most of the films used in the present invention are "continuous" in the sense that the underlying surface is completely covered with a uniform layer of the deposited material. Each of these layers and their functions is described in detail below.

1.1 Layer 102

When serving as a substrate, layer 102 provides dimensionally stable mechanical support to the printing member. The substrate should be strong, stable, and flexible. One or more surfaces (and, in some cases, bulk components) of the substrate may be hydrophilic. The topmost surface, however, is generally oleophilic. Suitable materials include, but are not limited to, polymers, metals and paper, but generally, it is preferred to have a polymeric ink-accepting layer (e.g., applied over a metal or paper support). As used herein, the term "substrate" refers generically to the ink-accepting layer beneath the radiation-sensitive layer 104, although the substrate may, in fact, include multiple layers (e.g., an oleophilic film laminated to an optional metal support, such as an aluminum sheet having a thickness of at least 0.001 inch, or an oleophilic coating over an optional paper support).

Substrate 102 desirably also exhibits high scattering with respect to imaging radiation. This allows full utilization of the radiation transmitted through overlying layers, as the scattering causes back-reflection into layer 104 and consequent increases in thermal efficiency. Polymers suitable for use in substrates according to the invention include, but are not limited to, polyesters (e.g., polyethylene terephthalate and polyethylene naphthalate), polycarbonates, polyurethane, acrylic polymers, polyamide polymers, phenolic polymers, polysulfones, polystyrene, and cellulose acetate. A preferred polymeric substrate is polyethylene terephthalate film, such as the polyester films available from DuPont-Teijin Films, Hopewell, Va. under the trademarks MYLAR and MELINEX, for example. Also suitable are the white polyester products from DuPont-Teijin such as MELINEX 927W, 928W 329, 329S, 331.

Polymeric substrates can be coated with a hard polymer transition layer to improve the mechanical strength and durability of the substrate and/or to alter the hydrophilicity or oleophilicity of the surface of the substrate. Ultraviolet- or EB-cured acrylate coatings, for example, are suitable for this purpose. Polymeric substrates can have thicknesses ranging from about 50 μm to about 500 μm or more, depending on the specific printing member application. For printing members in the form of rolls, thicknesses of about 200 μm are preferred. For printing members that include transition layers, polymer substrates having thicknesses of about 50 μm to about 100 μm are preferred.

Especially suitable substrates include aluminum, polyethylene terephthalate, polyethylene naphthalate and polyester laminated to an aluminum sheet. Substrates may be coated with a subbing layer to improve adhesion to subsequently applied layers.

1.2 Layer 104

Layer 104 ablates in response to imaging radiation, typically near-IR radiation. In general, layer 104 has a cured resin phase consisting essentially of a melamine resin and a resole resin, the latter being present in an amount ranging from 0% to 28% by weight of dry film. A near-IR absorber—typically a dye—is dispersed within the cured resin phase.

Suitable melamine resins include methylated, low-methylol, high-imino melamine materials. For example CYMEL cross-linkers from Cytek Industries, Inc., especially CYMEL 385, CYMEL 328, CYMEL 327, CYMEL 325 and CYMEL 323, may be employed. Melamine self-crosslinking or crosslinking with a resole resin, if present, may be facilitated by a sulfonic acid catalyst, typically a p-toluenesulfonic acid catalyst.

If the melamine component has a solution viscosity of 7000 to 15,000 centipoises at 23° C., and especially 8000 to 10,000 centipoises, and most especially 9000 centipoises, then the p-toluenesulfonic acid catalyst is desirably present at 1.5% or less by weight of dry film, especially 1.2% or less, most especially from about 1.2 to 0.7%, but not lower than 0.35%. If the melamine cross-linker has solution viscosity 1000 to 1600 centipoises at 23° C., especially 1100 to 1300 centipoises, and most especially 1100 centipoise, then the p-toluenesulfonic acid catalyst is desirably present at 6% or less by weight of dry film, especially 4.8% or less, most especially from about 4.8 to 2.8%, but not lower than 1.4%.

It appears that the polymeric matrix of layer 104 will not tolerate addition of co-resin together with the melamine, other than the limited amount of resole resin described above. For example, when polyvinylbutyral, phenolic resin or resole resin (in this case, at amounts greater than 28% by weight of dry film) is added into the composition, poor printing-plate durability and/or poor sensitivity result. In addition, the amount of resole added as a co-resin limits the amount of catalyst that can be used to make successful plates. For example, when the melamine resin has viscosity of 9000 centipoises and the matrix includes no resole, then the amount x of catalyst may be in the range $0.35\%<x<1.5\%$ by dry weight of film. If resole is added at 5%, however, then the acceptable range of catalyst level narrows to $0.35\%<x<1.2\%$. If resole is used at 15%, then the range narrows to $0.35\%<x<1\%$. Finally, if resole is used at 25%, then the range narrows to $0.35\%<x<0.7\%$. In addition, when the melamine resin has a viscosity of 1100 centipoises and the matrix includes no resole, then the amount x of catalyst may be in the range $1.4\%<x<6\%$ by weight of dry film. If resole is added at 5%, then the acceptable range of catalyst narrows to $1.4\%<x<4.8\%$. If resole is used at 15%, then the acceptable range of catalyst narrows to $1.4\%<x<4\%$. Finally, if resole is used at 25%, then the acceptable range of catalyst narrows to $1.4\%<x<2.8\%$.

Layer 104 desirably exhibits water compatibility following ablation. When layer 104 is only partially ablated, it is either (a) sufficiently water-compatible to be fully removed during cleaning, or (b) oleophilic if some of the layer remains even after cleaning. This layer should exhibit good adhesion to substrate 102, and resistance to age-related degradation is also desirable. Typically, layer 104 is cured and dried at 220 to 320° F., and especially 240 to 280° F. (i.e., approximately 104 to 160° C., especially 115 to 137° C.). Layer 104 has a dry coating weight of at least 0.1 $g/m^2$, or at least 0.25 $g/m^2$, or in some embodiments, at least 0.5 $g/m^2$.

In various embodiments, ablatability is achieved at a fluence of 200 $mJ/cm^2$ or less, and more preferably at a fluence of 150 $mJ/cm^2$ or less. The ablation threshold is dictated primarily by layer thickness and the loading level and efficiency of the absorber. Typically the absorbing dye is present at a loading level no more than 25%, although in various embodiments, it is no more than 18, 15 or even 12%. Furthermore, in some embodiments, an IR-absorptive pigment (e.g., carbon black) is added along with the dye at a loading level up to 20%, and in some implementations up to 25%.

1.3 Silicone Layer 106

The topmost layer participates in printing and provides the requisite lithographic affinity difference with respect to substrate 102; in particular, layer 106 is oleophobic and suitable for dry printing. In addition, the topmost layer 106 may help to control the imaging process by modifying the heat dissipation characteristics of the printing member at the air-imaging layer interface.

Typically, layer 106 is a silicone or fluoropolymer. Silicones are based on the repeating diorganosiloxane unit $(R_2SiO)_n$, where R is an organic radical or hydrogen and n denotes the number of units in the polymer chain. Fluorosilicone polymers are a particular type of silicone polymer wherein at least a portion of the R groups contain one or more fluorine atoms. The physical properties of a particular silicone polymer depend upon the length of its polymer chain, the nature of its R groups, and the terminal groups on the end of its polymer chain. Any suitable silicone polymer known in the art may be incorporated into or used for the surface layer.

Silicone polymers are typically prepared by cross-linking (or "curing") diorganosiloxane units to form polymer chains. The resulting silicone polymers can be linear or branched. A number of curing techniques are well known in the art, including condensation curing, addition curing, moisture curing. In addition, silicone polymers can include one or more additives, such as adhesion modifiers, rheology modifiers, colorants, and radiation-absorbing pigments, for example. Other options include silicone acrylate monomers, i.e., modified silicone molecules that incorporate "free radical" reactive acrylate groups or "cationic acid" reactive epoxy groups along and/or at the ends of the silicone polymer backbone. These are cured by exposure to UV and electron radiation sources. This type of silicone polymer can also include additives such as adhesion promoters, acrylate diluents, and multifunctional acrylate monomer to promote abrasion resistance, for example.

The silicone layer may have a dry coating weight of, for example, 0.5 to 2.5 g/m$^2$, with the range 1 to 2.5 g/m$^2$ being particularly preferred for typical commercial applications.

1.4 Optional Secondary Imaging Layer 108

Figure 1B:
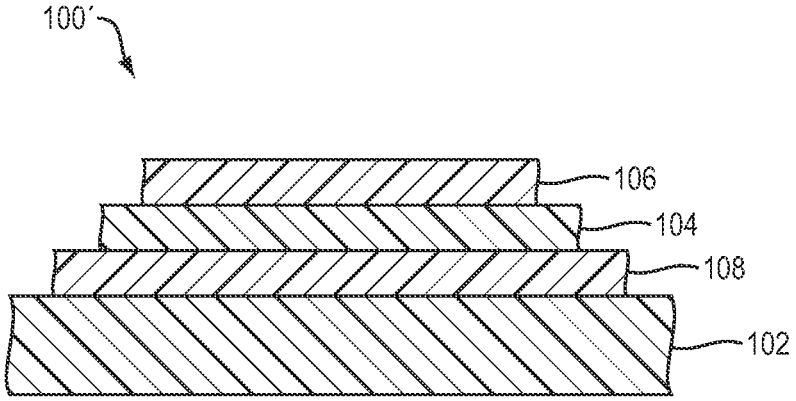

With reference to FIG. 1B, some embodiments 100' include an additional polymeric imaging layer 108 having an imaging pigment dispersed therein. Layer 108 can be any polymer capable of stably retaining, at the applied thickness, the IR-absorptive pigment dispersion (generally carbon black) adequate to cause ablation of the layer in response to an imaging pulse; and of exhibiting water compatibility following ablation. Furthermore, in embodiments where layer 108 is only partially ablated, it is either (a) sufficiently water-compatible to be fully removed during cleaning, or (b) oleophilic if some of layer remains even after cleaning. It is found that the carbon black enhances, or even confers, the desired water compatibility of layer 108 or the ablation debris thereof. Layer 108 should exhibit good adhesion to the overlying layer 104, and resistance to age-related degradation may also be considered.

In general, pigment loading levels are no greater than 20% or 25%, and the coating is applied at a dry weight of about 0.3 g/m$^2$. A typical composition for layer 108 includes or consists essentially of up to 25% carbon black, 60 to 90% resole resin (especially 70 to 80%), up to 20% melamine resin (usually about 10%), less than 5% catalyst and less than 2% surfactant/leveling agent.

2. Imaging of Printing Plates

Imaging of the printing member 100, 100' may take place directly on a press, or on a platemaker. In general, the imaging apparatus will include at least one laser device that emits in the region of maximum plate responsiveness, i.e., whose $\lambda_{max}$ closely approximates the wavelength region where the plate absorbs most strongly. Specifications for lasers that emit in the near-IR region are fully described in U.S. Pat. No. Re. 33,512 ("the '512 patent") and U.S. Pat. No. 5,385,092 ("the '092 patent"), the entire disclosures of which are hereby incorporated by reference. Lasers emitting in other regions of the electromagnetic spectrum are well-known to those skilled in the art.

Suitable imaging configurations are also set forth in detail in the '512 and '092 patents. Briefly, laser output can be provided directly to the plate surface via lenses or other beam-guiding components, or transmitted to the surface of a blank printing plate from a remotely sited laser using a fiber-optic cable. A controller and associated positioning hardware maintain the beam output at a precise orientation with respect to the plate surface, scan the output over the surface, and activate the laser at positions adjacent selected points or areas of the plate. The controller responds to incoming image signals corresponding to the original document or picture being copied onto the plate to produce a precise negative or positive image of that original. The image signals are stored as a bitmap data file on a computer. Such files may be generated by a raster image processor ("RIP") or other suitable means. For example, a RIP can accept input data in page-description language, which defines all of the features required to be transferred onto the printing plate, or as a combination of page-description language and one or more image data files. The bitmaps are constructed to define the hue of the color as well as screen frequencies and angles.

Other imaging systems, such as those involving light valving and similar arrangements, can also be employed; see, e.g., U.S. Pat. Nos. 4,577,932; 5,517,359; 5,802,034; and 5,861,992, the entire disclosures of which are hereby incorporated by reference. Moreover, it should also be noted that image dots may be applied in an adjacent or in an overlapping fashion.

The imaging apparatus can operate on its own, functioning solely as a platemaker, or can be incorporated directly into a lithographic printing press. In the latter case, printing may commence immediately after cleaning as described herein. The imaging apparatus can be configured as a flatbed recorder or as a drum recorder, with the lithographic plate blank mounted to the interior or exterior cylindrical surface of the drum. Obviously, the exterior drum design is more appropriate to use in situ, on a lithographic press, in which case the print cylinder itself constitutes the drum component of the recorder or plotter.

In the drum configuration, the requisite relative motion between the laser beam and the plate is achieved by rotating the drum (and the plate mounted thereon) about its axis and moving the beam parallel to the rotation axis, thereby scanning the plate circumferentially so the image "grows" in the axial direction. Alternatively, the beam can move parallel to the drum axis and, after each pass across the plate, increment angularly so that the image on the plate "grows" circumferentially. In both cases, after a complete scan by the beam, an image corresponding (positively or negatively) to the original document or picture will have been applied to the surface of the plate. In the flatbed configuration, the beam is drawn across either axis of the plate, and is indexed along the other axis after each pass. Of course, the requisite relative motion between the beam and the plate may be produced by movement of the plate rather than (or in addition to) movement of the beam.

Examples of useful imaging devices include models of the MAGNUS and TRENDSETTER imagesetters (available from Eastman Kodak Company) that utilize laser diodes emitting near-IR radiation at a wavelength of about 830 nm. Other suitable exposure units include the CRESCENT 42T Platesetter (operating at a wavelength of 1064 nm, available from Gerber Scientific, Chicago, Ill.) and the SCREEN PLATERITE 4300 series or 8600 series platesetter (available from Screen, Chicago, Ill.).

Following imaging, the printing member is subjected to an aqueous liquid to remove layers 104, 106 (and 108 if present) where the printing member received imaging radiation, thereby creating an imagewise pattern on the printing member. The aqueous liquid may consist essentially of water, e.g., it may be plain tap water. Alternatively, the aqueous liquid may comprise water and a component that eases the removal of silicone and ablation debris, facilitating faster and more efficient cleaning. The aqueous liquid may include not more than 20% (or not more than 15%) by weight of an organic solvent, e.g., an alcohol, and the alcohol may be a glycol (e.g., propylene glycol), benzyl alcohol and/or phenoxyethanol. The aqueous liquid may comprise a surfactant and/or may be heated to a temperature greater than about 80° F.

EXAMPLES

Examples 1, C1 and C2

These examples involve negative-working waterless printing plates that include an oleophobic silicone layer, disposed on an imaging layer comprising an IR-absorbing dye and a polymer disposed on a polyester substrate. A preferred substrate is a 175 μm white polyester film sold by DuPont Teijin Films (Hopewell, Va.) labeled MELINEX 331. This is an opaque white film pretreated on one side to promote adhesion to solvent-based coatings.

Examples of formulations used for the IR-absorbing imaging layer are as follows:

| | Parts by Weight | | |
|---|---|---|---|
| Components | Example 1 | Comparative Example C1 | Comparative Example C2 |
| Cymel 385 | 3.48 | 0.45 | 0.17 |
| HRJ 12362 | — | 3.04 | 0.42 |
| Butvar B98 | — | — | 2.90 |
| S0094 NIR Dye | 0.78 | 0.78 | 0.78 |
| Cycat 4040 | 0.03 | 0.03 | 0.03 |
| BYK 307 | 0.06 | 0.06 | 0.06 |
| Dowanol PM | 95.65 | 95.64 | 95.64 |

CYMEL 385 is a methylated, low-methylol, high-imino melamine resin supplied as an 80% solids mix with water by Cytek industries, Inc. (West Paterson, N.J.). This sample has viscosity of 9000 centipoises at 23° C. The HRJ-12362 is a phenol formaldehyde thermosetting resin supplied in a 60% n-butanol solution by the SI Group, Inc (Schenedtady, N.Y.). CYCAT 4040 is a general purpose, p-toluenesulfonic acid catalyst supplied as a 40% solution in isopropanol by Cytek Industries, Inc. BYK 307 is a polyether modified polydimethylsiloxane surfactant supplied by BYK Chemie (Wallingford, Conn.). The solvent, DOWANOL PM, is propylene glycol methyl ether available from the Dow Chemical Company (Midland, Mich.). Butvar B98 is polyvinylbutyral from Brenntag Specialties, Inc., Philadelphia, Pa. S0094 is a cyanine near IR dye manufactured by FEW Chemicals GmbH (Bitterfeld-Wolfen, Germany), which has a reported coefficient of absorption of $2.4\times10^5$ L/mol-cm at the maximum absorption wavelength, $\lambda_{max}$, of about 813 nm (measured in methyl ethyl ketone (MEK) solution). This dye exhibits very good solubility in the preferred solvent, DOWANOL PM, used in the formulations described herein.

The coating solutions were applied to the polyester substrate using a wire-round rod and then dried and cured at 150° C. (measured on the web) to produce dried coatings of about 0.5 g/m$^2$. Drying and curing were carried out on a belt conveyor oven, SPC Mini EV 48/121, manufactured by Wisconsin Oven Corporation (East Troy, Wis.). The conveyor was operated at a speed of 3.2 feet/minute, which gives a dwell time of about 40 seconds in the air-heated zone of the oven. The actual temperatures on the polymer substrate were measured with calibrated temperature strips. In this oven, the temperature dial was set to 160° C. to bring the polymer web to the preferred curing temperature of 150° C.

The oleophobic silicone top layer of the plate members was subsequently disposed on the dried and cured imaging layer using the formulation given below. The silicone layer exhibits a highly crosslinked network structure produced by the addition or hydrosilylation reaction between the vinyl groups (SiVi) of vinyl-terminated functional silicones and the silyl (SiH) groups of trimethylsiloxy-terminated poly(hydrogen methyl siloxane) crosslinker, in the presence of a Pt catalyst complex and an inhibitor.

| Component | Parts |
|---|---|
| PLY-3 7500P | 12.40 |
| DC Syl Off 7367 Crosslinker | 0.53 |
| CPC 072 Pt Catalyst | 0.17 |
| Heptane | 86.9 |

The PLY-3 7500P is an end-terminated vinyl functional silicone resin, with average molecular weight 62,700 g/mol, supplied by Nusil Silicone Technologies (Charlotte, N.C.). The DC SYL OFF 7367 is a trimethylsiloxy-terminated poly (hydrogen methylsiloxane) crosslinker manufactured by Dow Corning Silicones (Midland, Mich.) which is supplied as a 100% solids solution containing about 30% 1-ethynylcyclohexane [$C{\equiv}CH{-}CH(CH_2)_5$], which functions as catalyst inhibitor. The CPC 072 is a 1,3 diethyenyl-1,1,3,3-tetramethyldisiloxane Pt complex catalyst, manufactured by Umicore Precious Metals (South Plainfield, N.J.), which is supplied as a 3% xylene solution. The formulation solvent, heptane, is supplied by Houghton Chemicals (Allston, Mass.).

The silicone formulation was applied to the polymer imaging layers with a wire-round rod, then dried and cured at 150° C. (measured on the web) to produce uniform silicone coatings of 2 g/m$^2$ using the same oven and conditions above. The printing members were evaluated as follows to assess solvent resistance, environmental stability, and imaging sensitivity.

1. Plates stored at ambient conditions are tested by assessing solvent resistance with MEK. An MEK resistance test is conducted on pieces (~20 cm length) of the plate samples by applying, in a reciprocating mode at a five-pound load, double-rubs with a cotton towel saturated with MEK. The cycle is repeated to the point of visual evidence failure: marring of the surface or loss of silicone adhesion. To pass this test, the plates should resist more than 10 cycles of the test without showing signs of failure.

2. Fresh plate samples that pass the MEK resistance test (more than 10 MEK rubs) are exposed to accelerated aging conditions to determine their environmental stability. For this purpose, the MEK resistance test is repeated on samples that have been exposed to high temperature and humidity conditions (18 hours in an environmental chamber operated at 80° C. and 75% relative humidity.) To pass this test, aged samples should withstand more than five cycles of the MEK resistance test (more than five MEK rubs) without showing signs of failure.

3. Plate precursors are imaged on a KODAK TRENDSETTER image-setter (operating at a wavelength of 830 nm, available from Eastman Kodak Company). Sensitivity information is obtained from the evaluation of different imaging patterns (solid screen, 3×3, and 2×2 patterns) run at increasing power levels (15 mJ/cm$^2$ steps) at a constant drum speed of 150 rpm. The imaged plates are manually cleaned to remove the loosened silicone debris left on the plate after imaging. Cleaning comprises a two-step procedure: first, dry rubbing the surface with a cotton towel, and second, wet rubbing with a cotton towel saturated with isopropanol.

The degree of plate sensitivity is ascertained from print sheets obtained by running the cleaned plates on a GTO Heidelberg press using black ink (Aqualess Ultra Black MZ waterless ink, Toyo Ink America LLC, Addison, Ill.) and uncoated stock (Williamsburg Plus Offset Smooth, 60 lb white, item no. 05327, International Paper, Memphis, Tenn.). The samples are run for at least 200 impressions. For purposes hereof, a high-speed plate embodiment is defined as one that produces print sheets showing well-defined high resolution patterns (2×2 and 3×3) at power levels below or equal to 200 mJ/cm$^2$. Plates requiring power levels higher than 200 mJ/cm$^2$ to produce prints with high-resolution patterns are classified as not passing this test.

The following table presents results of the evaluation procedures for Example 1 versus comparative examples C1 and C2:

| | MEK Rubs | | Imaging Sensitivity |
|---|---|---|---|
| Example | Fresh | Aged | (mJ/cm$^2$) |
| Example 1 | 30-35 | 15-20 | 130 |
| Example C1 | 40-45 | 30-35 | >240 |
| Example C2 | 0-5 | Not completed | >240 |

The results show that the composition of Example 1 produces a durable and high-sensitivity waterless printing member. The fresh and aged plate embodiments of this example display very good solvent resistance and the power requirement for imaging is well below the established limit of 200 mJ/cm$^2$. Comparative Examples C1 and C2 do not satisfy our performance criteria: C1 displays excellent durability but fails due to the very poor imaging sensitivity and Example C2 displays very poor durability and imaging sensitivity.

Examples 2, C3 and C4

These examples involve waterless printing plates having resole-melamine imaging layers with variable resole/melamine resin ratios. Formulation examples are given in the following table for imaging layers made with lower resole resin content than those of Example C1.

| | Parts by Weight | | |
|---|---|---|---|
| Components | Example 2 | Comparative Example C3 | Comparative Example C4 |
| Cymel 385 | 3.06 | 2.44 | 1.40 |
| HRJ 12362 | 0.53 | 1.30 | 2.60 |
| S0094 NIR Dye | 0.78 | 0.78 | 0.78 |
| Cycat 4040 | 0.03 | 0.03 | 0.03 |
| BYK 307 | 0.06 | 0.06 | 0.06 |
| Dowanol PM | 95.54 | 95.39 | 95.13 |

These imaging-layer formulations were applied with a wire-round rod to polyester and dried and cured at 150° C. using the same oven and conditions described above to provide a coating of about 0.5 g/m$^2$. Next, they were coated with the silicone layer described in the previous examples.

The plates were evaluated using the same procedure as above, and the results are summarized in the following table:

| | MEK Rubs | | Imaging Sensitivity |
|---|---|---|---|
| Example | Fresh | Aged | (mJ/cm$^2$) |
| Example 2 | 45-50 | 25-30 | 160-180 |
| Example C3 | 40-45 | 30-35 | 210 |
| Example C4 | 35-45 | 30-35 | 210-225 |

The printing plate of Example 2 exhibits good sensitivity and durability. Examples C3 and C4, by contrast, display very good durability but poor sensitivity (power requirements>200 mJ/cm$^2$). The addition of the resole to the imaging layer helps improve durability but also causes considerable loss of plate sensitivity. The resole levels of the imaging layer should be kept below 28% to produce durable waterless printing plates having adequate sensitivity.

Examples 3 and 4

In Example 3, a melamine resin imaging layer and topmost silicone layer were disposed on an aluminum substrate. The melamine imaging layer was similar to that of Example 1, but included a visible dye (added to enhance image/non-image contrast of the plate). A preferred substrate is a 200 μm (0.008 inch) anodized aluminum (1052 aluminum alloy, electrochemically etched and anodized to give an anodic layer with Ra values in the order of 0.300 μm.) In Example 4, the imaging layer formulation was disposed on the same polyester substrate used in Example 1 and subsequently coated with the same silicone layer.

The melamine formulation used for these examples is given below:

| Components | Parts by Weight Examples 3 and 4 |
|---|---|
| Cymel 385 | 3.38 |
| S0094 NIR Dye | 0.78 |
| Victoria Blue R | 0.11 |
| Cycat 4040 | 0.03 |
| BYK 307 | 0.06 |
| Dowanol PM | 95.64 |

Victoria Blue R is a visible dye with an absorption maximum $\lambda_{max}$ at 615 nm, and is supplied by Sigma-Aldrich (Saint Louis, Mo.) as a solid mixture with 85% dye content.

The imaging formulation was applied with a wire-round rod and dried/cured at 150° C. (measured on the web) to provide a coating of about 0.5 g/m$^2$. The oven conveyor was run at 3.2 ft/min. For the aluminum substrate, the temperature set on the oven dial was 150° C. and agrees with the temperature measured on the metal substrate with the temperature strips. For polyester, conditions are as described in Example 1.

The plate samples were evaluated according to the procedures described above and the results are summarized in the following table:

| Example | Substrate | MEK Rubs Fresh | MEK Rubs Aged | Imaging Sensitivity ($mJ/cm^2$) |
|---|---|---|---|---|
| Example 3 | Aluminum | 20-25 | 20-25 | 130 |
| Example 4 | Polyester | Not completed | Not completed | 130 |

In these examples, the melamine resin imaging layer yields durable and fast waterless printing members on both polyester and aluminum substrates.

Examples 5, 6 and C5-C8

Plates were made with melamine resin imaging layers having varying catalyst concentrations. The below table includes a series of melamine resin layers made with catalyst levels higher and lower than that of Example 1.

| | Parts by Weight | | | | | |
|---|---|---|---|---|---|---|
| | Example C5 | Example C6 | Example 5 | Example 6 | Comparative Example C7 | Comparative Example C8 |
| Cymel 385 | 3.41 | 3.40 | 3.38 | 3.35 | 3.30 | 3.27 |
| S0094 NIR Dye | 0.78 | 0.78 | 0.78 | 0.78 | 0.78 | 0.78 |
| Victoria Blue | 0.11 | 0.11 | 0.11 | 0.11 | 0.11 | 0.11 |
| Cycat 4040 | 0.00 | 0.005 | 0.02 | 0.05 | 0.11 | 0.13 |
| BYK 307 | 0.06 | 0.06 | 0.06 | 0.06 | 0.06 | 0.06 |
| Dowanol PM | 95.64 | 95.645 | 95.65 | 95.65 | 95.64 | 95.65 |

The formulations were applied with a wire-round rod to polyester, as described in Example 1, and dried and cured at 150° C. to provide a coating of about 0.5 $g/m^2$. Furthermore, the silicone formulation given in the previous examples was disposed on the dried and cured imaging layer.

The following table summarizes the properties measured for these examples:

| Example | MEK Rubs Fresh | MEK Rubs Aged | Imaging Sensitivity ($mJ/cm^2$) |
|---|---|---|---|
| Example C5 | 15-20 | 0-5 | 130 |
| Example C6 | 10-20 | 0-5 | 130 |
| Example 5 | 10-20 | 4-8 | 130 |
| Example 6 | 30-40 | 20-30 | 180 |
| Example C7 | 30-40 | 0-5 | 195 |
| Example C8 | 40-45 | 0-5 | 230 |

The results show that printing members incorporating a melamine imaging layer having very low (i.e., lower than 0.35%, including 0 in the dry coating) and high (i.e., higher than 1.5% in the dry coating) levels of catalyst do not exhibit sufficient environmental stability. In addition, there is also a noticeable decrease of imaging sensitivity for samples with melamine layers having excessive catalyst levels (>1.5% in the dry coating). The catalyst level of the dried melamine imaging layer should be higher than 0.35% but lower than 1.5% to produce durable, stable, and highly sensitive waterless plates.

Examples 7 and 8

These examples pertain to waterless printing plates made with melamine imaging layers having lower IR-absorbing dye concentrations than that of Example 1. Plate samples utilized the 175 μm white polyester MELINEX 331 film supplied by DuPont Teijin Films (Hopewell, Va.). The following table sets forth the formulations:

| Components | Parts by Weight Example 7 | Parts by Weight Example 8 |
|---|---|---|
| Cymel 385 | 3.52 | 3.66 |
| S0094 NIR Dye | 0.66 | 0.53 |
| Victoria Blue | 0.11 | 0.11 |
| Cycat 4040 | 0.03 | 0.03 |
| BYK 307 | 0.06 | 0.06 |
| Dowanol PM | 95.62 | 95.61 |

The imaging-layer formulations were applied with a wire-round rod and dried and cured at 150° C. to provide a coating of about 0.5 $g/m^2$ as previously described. The silicone formulation given in the previous examples was disposed on the dried and cured imaging layer. The following table summarizes the results:

| Example | MEK Rubs Fresh | MEK Rubs Aged | Imaging Sensitivity ($mJ/cm^2$) |
|---|---|---|---|
| Example 7 | 25-30 | 20-25 | 130-150 |
| Example 8 | 25-30 | 15-25 | 150 |

These examples provide durable and fast-imaging waterless printing plates. Plate samples with melamine imaging layers having dye contents as low as 12% (dry coating) are within the scope of the present invention.

Examples 9-11

In Examples 9 and 10, the imaging layers have formulations similar to that of Example 1 but use alternate IR-absorptive dyes (having absorption maxima higher than 820 nm and/or broader absorption bands covering a wider portion of the near-IR spectrum). Example 11 is a plate member with a melamine resin layer containing a blend of two dyes.

Formulations of imaging layers for these examples are set forth in the following table:

| Components | Parts by Weight Example 9 | Parts by Weight Example 10 | Parts by Weight Example 11 |
|---|---|---|---|
| Cymel 385 | 3.48 | 3.48 | 3.48 |
| S0094 | — | — | 0.53 |
| S 2058 NIR Dye | — | 0.78 | 0.25 |
| Epolight 5588 | 0.78 | — | — |
| Cycat 4040 | 0.03 | 0.03 | 0.03 |

-continued

| Components | Parts by Weight Example 9 | Example 10 | Example 11 |
|---|---|---|---|
| BYK 307 | 0.06 | 0.06 | 0.06 |
| Dowanol PM | 95.65 | 95.65 | 95.65 |

S 2058 is a cyanine dye supplied by FEW Chemical GmbH with a reported absorption maximum, $\lambda_{max}$, at about 970 nm. EPOLIGHT 5588 is a cyanine dye, manufactured by Epolin, Inc. (Newark, N.J.), with an absorption maximum at about 860 nm. These are high-absorptivity dyes with coefficients of extinction (at $\lambda_{max}$) comparable to that of the S0094 dye used in previous examples.

The examples were imaged (GATF target) on plate-setters operating at different wavelengths using a nominal power of ~270 mJ/cm$^2$. Three different image-setters were employed:

a) KODAK TRENDSETTER, which operates at a wavelength of 830 nm (150 rpm drum speed, 16.5 watts laser power);
b) Presstek DIMENSION 425 image-setter operating at a wavelength of 915 nm (and operating the diodes at an average current of 1100 mA); and
c) Presstek DIMENSION 425 image-setter equipped with laser diodes emitting near-IR radiation at a wavelength of ~975 nm (operating the diodes at an average current of 1250 mA).

Examples 9, 10 and 11 image well on all these devices at 270 mJ/cm$^2$. After cleaning, as in example 1, solid patterns and 2 to 98% dots were well resolved. Example 11 was imaged again on the Kodak Trendsetter, this time at 195 mJ/cm$^2$ (150 rpm drum speed, 12 watts laser power, plot 0 test target). After cleaning, as described in example 1, the sample was mounted on the GTO press and printed at least 200 impressions showing well defined 2×2 and 3×3 pixel patterns. Examples 9 and 10 are imaged on the Kodak Trendsetter at 195 mJ/cm$^2$. After cleaning and evaluating on the GTO press, well-defined high-resolution patterns (2×2 and 3×3 pixel patches) are expected in all cases.

Example 12

This example involves a waterless printing plate in which the melamine imaging layer and the silicone layer described in Example 1 are disposed on a black polyester substrate. Carbon-filled polyester Hostaphan BSAC, supplied by Mitsubishi Polyester Film (Greer, S.C.), was used for this work. This polyester film is treated on both sides to promote adhesion to silicone adhesives. It was verified that this example displays good durability. On an MEK rub test, the sample measured 25 to 30 rubs when fresh. A sample was imaged on the Kodak Trendsetter at 180 mJ/cm$^2$ (150 rpm drum speed, 11 watts laser power). After cleaning, as described in Example 1, the sample exhibited well defined 2×2 and 3×3 pixel patches.

Examples 13 and C9

Example 13 involves three-layer plates in which the silicone and imaging layers of Example 1 are disposed on a thin carbon-polymer matrix layer that is itself disposed on a polyester substrate pretreated with an adhesion-promotion layer. A preferred substrate is the pretreated 175 μm white polyester film sold by DuPont Teijin Films (Hopewell, Va.) used in Example 1. Example C9 involves a two-layer structure in which the silicone layer is directly disposed on the carbon layer disposed on the same polyester substrate.

The formulation of the carbon layer of these examples is as follows:

| Components | Parts by Weight |
|---|---|
| HRJ 12362 | 3.50 |
| Micropigmo AMBK-2 | 2.12 |
| Cymel 385 | 0.21 |
| Cycat 4040 | 0.26 |
| BYK 307 | 0.07 |
| Dowanol PM | 93.84 |

The Micropigmo AMBK-2 is a 20% solids proprietary carbon dispersion supplied by Orient Corporation of America (Kenilworth, N.H.). The dispersion has a 10% content of carbon in a polyvinyl butyral resin matrix.

This layer was applied with a wire-round rod and dried and cured 150° C. using the same oven and conditions described above (for polyester) to yield a coating of about 0.3 g/m$^2$. The melamine imaging layer and the silicone layer described in Example 1 were subsequently disposed on the carbon layer.

The following table presents a comparison of the properties measured on these two examples using the procedures previously described:

| Example | MEK Rubs Fresh | Aged | Imaging Sensitivity (mJ/cm$^2$) |
|---|---|---|---|
| Example 13 | 40-45 | 20-25 | 150-160 |
| Example C9 | 35-45 | Not completed | >>240 |

Example 13 exhibits good sensitivity and durability. The two-layer structure of Example C9, which does not include the melamine-dye interlayer, displays good durability but very poor imaging performance.

Examples 14 and 15

In Example 14, a melamine resin imaging layer and topmost silicone layer were disposed on an aluminum substrate. The melamine imaging layer was similar to that of Example 1, but included a visible dye (added to enhance image/non-image contrast of the plate), and the CYMEL 385 has viscosity of 1100 centipoises at 23° C. A preferred substrate is a 200 μm (0.008 inch) anodized aluminum. In Example 15, the imaging-layer formulation was applied to the polyester substrate used in Example 1 and subsequently coated with the same silicone layer.

The melamine formulation used for these examples is given below:

| Components | Parts by Weight Examples 14 and 15 |
|---|---|
| Cymel 385 | 3.28 |
| S0094 NIR Dye | 0.78 |
| Victoria Blue R | 0.11 |
| Cycat 4040 | 0.13 |
| BYK 307 | 0.06 |
| Dowanol PM | 95.64 |

The imaging layer formulation was applied with a wire-round rod and dried and cured at 138° C. on the aluminum substrate and 127° C. on the polyester substrate (temperatures set on the oven dial) to provide coatings of about 0.5 g/m$^2$. The conveyor of the Wisconsin oven, described in Example 1, was run at 3.2 ft/min.

The plate samples were evaluated according to the procedures described above and the results are summarized in the following table:

| | | MEK Rubs | | Imaging Sensitivity |
|---|---|---|---|---|
| Example | Substrate | Fresh | Aged | (mJ/cm$^2$) |
| Example 14 | Aluminum | 25-30 | 25-30 | 195 |
| Example 15 | Polyester | 45-50 | 35-40 | 150-160 |

The melamine resin imaging layer yields durable and fast waterless printing members on both polyester and aluminum substrates.

Although the present invention has been described with reference to specific details, it is not intended that such details should be regarded as limitations upon the scope of the invention, except as and to the extent that they are included in the accompanying claims.

What is claimed is:

1. A dry printing member comprising:

(a) an oleophilic first layer that exhibits high scattering of near-IR radiation;

(b) disposed over the first layer, an imaging layer having (i) a cured resin phase consisting essentially of a melamine resin and a resole resin, the resole resin being present in an amount ranging from 0% to 28% by weight of dry film, and (ii) dispersed within the cured resin phase, a near-IR absorber; and (c) disposed over the imaging layer, an oleophobic third layer.

2. The printing member of claim 1, wherein the cured resin phase contains at least 1.3% resole resin by weight.

3. The printing member of claim 2, wherein the resole resin constitutes no more than 15% of the imaging layer by weight.

4. The printing member of claim 2, wherein the resole resin constitutes no more than 28% of the imaging layer by weight.

5. The printing member of claim 1, wherein the near-IR absorber consists essentially of a dye.

6. The printing member of claim 1, wherein the near-IR absorber constitutes no more than 25% of the imaging layer by weight of dry film.

7. The printing member of claim 1, wherein the melamine resin constitutes no more than 88% of the imaging layer by weight.

8. The printing member of claim 1, wherein the melamine resin is a methylated, low-methylol, high-imino melamine.

9. The printing member of claim 1, wherein the melamine resin has a viscosity ranging from 7000 to 15,000 centipoises at 23° C.

10. The printing member of claim 1, wherein the melamine resin has a viscosity ranging from and 1000 to 1600 centipoises at 23° C.

11. The printing member of claim 1, wherein the imaging layer has a dry coating weight of at least 0.5 g/m$^2$.

12. The printing member of claim 1, wherein the third layer consists essentially of silicone.

13. The printing member of claim 1, wherein the first layer is white.

14. The printing member of claim 1, wherein the first layer is metal.

15. The printing member of claim 1, further comprising a fourth layer disposed between the first and second layers, the fourth layer comprising a cured polymer containing a dispersion of near-IR-absorbing pigment.

16. The printing member of claim 15, wherein the pigment is carbon black.

17. The printing member of claim 15, wherein the pigment is present at a loading level no greater than 25% by weight.

18. A method of imaging and printing with a dry printing member, the method comprising the steps of:

(a) providing a printing member comprising (i) a white, polymeric, oleophilic first layer;

(ii) disposed over the first layer, an imaging layer having (A) a cured resin phase consisting essentially of a melamine resin and a resole resin, the resole resin being present in an amount ranging from 0% to 28% by weight of dry film, and (B) dispersed within the cured resin phase, a near-IR absorber; and (iii) disposed over the imaging layer, an oleophobic third layer;

(b) exposing the printing member to imaging radiation in an imagewise pattern, the imaging radiation at least partially ablating the imaging layer where exposed and being back-reflected into the imaging layer by the oleophilic first layer;

(c) subjecting the printing member to an aqueous liquid to remove the imaging and third layers where the printing member received imaging radiation, thereby creating an imagewise pattern on the printing member; and (d) printing with the printing member by applying waterless ink thereto and transferring the ink to a recording medium in the imagewise pattern.

19. The method of claim 18, wherein the imaging radiation has a fluence not exceeding 200 mJ/cm$^2$.

20. The method of claim 18, wherein the imaging radiation has a fluence not exceeding 150 mJ/cm$^2$.

21. The method of claim 18, wherein the aqueous liquid is plain tap water.

22. The method of claim 18, wherein the aqueous liquid comprises water and an organic solvent.

23. The method of claim 22, wherein the organic solvent is an alcohol.

24. The method of claim 23, wherein the alcohol is a glycol.

25. The method of claim 18, wherein the printing member further comprises a fourth layer disposed between the first and second layers, the fourth layer comprising a cured polymer containing a dispersion of near-IR-absorbing pigment.

26. A method of making a dry ablation-type printing member, the method comprising the steps of:

(a) providing a precursor structure having an oleophilic surface that exhibits high scattering of near-IR radiation;

(b) coating, over the precursor structure, a resin composition having (A) a resin phase consisting essentially of a melamine resin and a resole resin, the resole resin being present in an amount ranging from 0% to 28% by weight of dry film, and dispersed within the resin phase, a near-IR absorber;

(c) curing the resin composition;

(d) following step (c), coating, over the cured resin composition, an oleophobic polymer composition; and (e) curing the oleophobic polymer composition.

27. The method of claim 26 wherein the resin composition is cured at a temperature ranging from 220 to 320° F.

28. The method of claim 26 wherein the resin composition is cured at a temperature ranging from 240 to 280° F.

* * * * *